US005083388A

United States Patent [19]

Cooley

[11] Patent Number: 5,083,388

[45] Date of Patent: Jan. 28, 1992

[54] SNOW REMOVAL APPARATUS

[76] Inventor: John Cooley, 1310 Juniper, Idaho Falls, Id. 83404

[21] Appl. No.: 604,521

[22] Filed: Oct. 29, 1990

[51] Int. Cl.[5] ..... E01H 5/06

[52] U.S. Cl. ..... 37/268; 37/285

[58] Field of Search ..... 37/285, 266, 268, 270, 37/265, 264; 294/54.5

[56] References Cited

U.S. PATENT DOCUMENTS

| | | | |
|---|---|---|---|
| 3,091,790 | 6/1963 | Schroeder | 37/285 X |
| 3,773,375 | 11/1973 | Nehis . | |
| 3,998,486 | 12/1976 | Mittelstadt | 37/285 |
| 4,024,654 | 5/1977 | Snyder | 37/268 |
| 4,089,127 | 5/1978 | Maijala | 37/268 |
| 4,185,403 | 1/1980 | Hardgrove | 37/285 X |
| 4,249,767 | 2/1981 | Andreasen . | |
| 4,386,474 | 6/1983 | Mechavich et al. | 37/285 |
| 4,729,199 | 3/1988 | Oller | 37/285 X |

*Primary Examiner*—Dennis L. Taylor
*Assistant Examiner*—J. Russell McBee
*Attorney, Agent, or Firm*—Robert A. de Groot; Stephen A. Gratton

[57] ABSTRACT

A snow removal apparatus that can be used to remove snow from a pitched roof while the operator is on the ground or also when the operator is on the roof. The apparatus includes two vertical snow-cutting blades, a horizontal cutting blade, and a roller assembly having a sheet of plastic on the roller. When in use, the operator unrolls the plastic and pushes the blades through the snow cutting loose a square section which then slides down the plastic to the ground as the apparatus moves up the roof line.

9 Claims, 4 Drawing Sheets

SNOW REMOVAL APPARATUS

FIELD OF THE INVENTION

This invention relates to a snow removal apparatus that can remove snow from a pitched roof from the ground, from a ladder on the ground, or from the roof peak.

BACKGROUND OF THE INVENTION

Many homes and buildings are constructed with pitched roof design. The roofs of such buildings are generally covered by asbestos, tile, wooden shingles, metal sheeting, or some other type of roof covering. In the areas of the world where snow accumulations are experienced, it will be apparent that most often there is a necessity for removing such accumulations of snow from building roofs, particularly in colder climates.

Because building roofs are not perfect heat insulators, heat escaping from heated buildings tends to melt snow immediately adjacent the shingles or the roof covering, resulting in water from the melted snow running downward to the eaves and into the gutters and downspouts, where the lower periphery of such roof generally is not subject to heat loss from within the house. Because of freezing conditions usually present at this eaves surface, water freezing in the eaves, gutters, and downspouts tend to force other melted water to back upwardly onto the roof eaves where freezing conditions form an ice dam which in turn causes additional melted snow water to back up on the roof. In the areas of such roof where heat loss occurs, this melted water seeps under the shingles where it can and often does cause leaks in the roof. These leaks can and sometimes do cause serious damage, not only to the roof as such but also to the internal walls, ceilings, and floor coverings, because of the snow accumulations on such roof. Melted snow water seeps under the shingles, both as a result of heat escaping through the roof of such heated building, or thawing daytime temperatures alternating with subzero conditions at night.

Various types of electrical heating devices, such as heat tapes and the like, have been installed to minimize the freezing of water in the eaves, gutters, and downspouts as a means to prevent the above mentioned ice dams from forming. Because such heating devices provide only heat sufficient to melt snow or ice immediately adjacent such tapes, the ice can continue to form, causing the melted snow water to back up and seep under the shingles, thus rendering such heating systems as ineffective.

It is thus generally necessary to mechanically remove the snow from the roof. Prior art attempts to reduce the risks of snow shoveling from roofs include the portable tool for removing snow from pitched roofs disclosed in U.S. Pat. No. 4,249,767. The device is operated from the ground and has a square U-shaped body and wheels or skids that roll the body up the roof cutting through a square section of snow as it progresses. When the device is at the peak of the roof, a flat blade portion of the body rotates upward to create a broad surface that pushes the snow down the roof as the shoveller pulls the device down the roof. This type of device requires a force to push the body through the snow on the upward pass and a greater force to pull the device and packed snow down the roof on the downward pass.

U.S. Pat. No. 3,773,375 discloses another fixed blade type of roof snow shovel where the blade would have to be lifted over the snow to the roof peak, dropped down into the snow, and then pulled down the roof pushing the snow down with the blade. Again, this is an inefficient and tiring method.

It will be recognized that another means of snow removal from roofs includes the standard snow shovel, which has been in use for many years and continues to be the tool most often implemented for the removal of snow from roofs. While the snow shovel has been an effective method for removing snow from roofs, shoveling snow embodies risks to the user of such devices, such as strains from lifting the shovel and strokes or heart attacks from over-exertion, as well as the ever present danger of falling off the roof because of the slippery conditions, nearly always present throughout the entire snow removal process.

The above cited health risks become more apparent in the case of the elderly or those persons who have known health problems or those who, for one reason or another, are not physically conditioned for such strenuous undertakings.

It is the general object of the present invention to provide a means for safe, effective, and efficient removal of snow accumulations from building roofs which have been designed as single or multiple story structures. It will become apparent as the ensuing discussion develops that the present invention is constructed of materials light in weight, portable, easy to disassemble for storage or shipment, and safe for the elderly to operate as well as persons younger, stronger, and more agile. This device is designed more particularly for snow removal from inclined roofs. The operator can stand at ground level, use a ladder leaned against the building roofs eaves, or stand on a self-supporting ladder placed a few feet outwardly from the base of the building. Also, on a shallow-pitched roof, an operator can stand on the roof top either in the snow accumulations or straddling the ridge of the roof. Removal of snow from roofs is accomplished by pushing upwards on the tool when on the ground or pulling upwards on the snow removal tool when standing on the roof. In either of the aforementioned positions, the device effectively overcomes the disadvantages of prior art, i.e. extra force or lifting is required in both directions of the shovelling motion. This snow removal device is both easy to use and safe for those persons who are generally in good health and active enough to be able to position themselves on a roof or stand on a ladder, or else stand on the ground while operating the device.

SUMMARY OF THE INVENTION

In accordance with the present invention, an efficient roof snow removal apparatus is provided. Simply stated, the apparatus provides means for placing a slippery or frictionless surface on the roof and means for directing snow from the roof onto the slippery surface so that it may fall from the roof. The apparatus of the invention generally stated comprises a handle, snow cutting means in the form of a pair of vertical snow cutting blades affixed to the ends of a horizontal blade and to the handle, and means for placing a frictionless surface on the roof in the form of a roller assembly for storing or unrolling a plastic sheet onto the roof. To use the apparatus from the ground, the plastic sheet is unrolled and the apparatus is placed on the roof eaves, then pushed upwards through the snow. The vertical and horizontal blades make a square cut section in the snow. The cut snow is directed by the blades onto the plastic sheet and slides to the ground as the apparatus is moved up the roof line. The handle has extension sections that can be snapped in place to reach higher or longer roof lines.

A unique feature of the horizontal blade is that it is hinged near the forward cutting portion of the blade so that it can rest on the roller assembly when the plastic is unrolled, or rest on the rolled-up plastic sheet when the plastic is rolled up for storage. Additionally, the vertical cutting blades ar hinged at the lower portion so they also can fold down for storage.

In another configuration, the handle may be reversed on the cutting blade allowing the operator to clear snow from a roof while on the roof peak. In this configuration, two elongated runners are attached to the lower cutting frame so that the blade can be extended beyond the roof eaves at the start of an upward pull stroke. As the cutting frames and horizontal blade are pulled up the roof, a square section of snow is cut and again slides over the blade onto the plastic to slide to the ground.

When snow removal is completed, the plastic sheet is rolled up on the roller assembly by a crank means at one end of a roller rod and tube that captures one end of the plastic sheet. The handle telescopic sections can be disengaged and the vertical upper cutting frames folded down for storage, making a compact device.

Other objects, advantages, and capabilities of the present invention will become more apparent as the description proceeds.

DETAILED DESCRIPTION OF THE INVENTION

Figure 1:
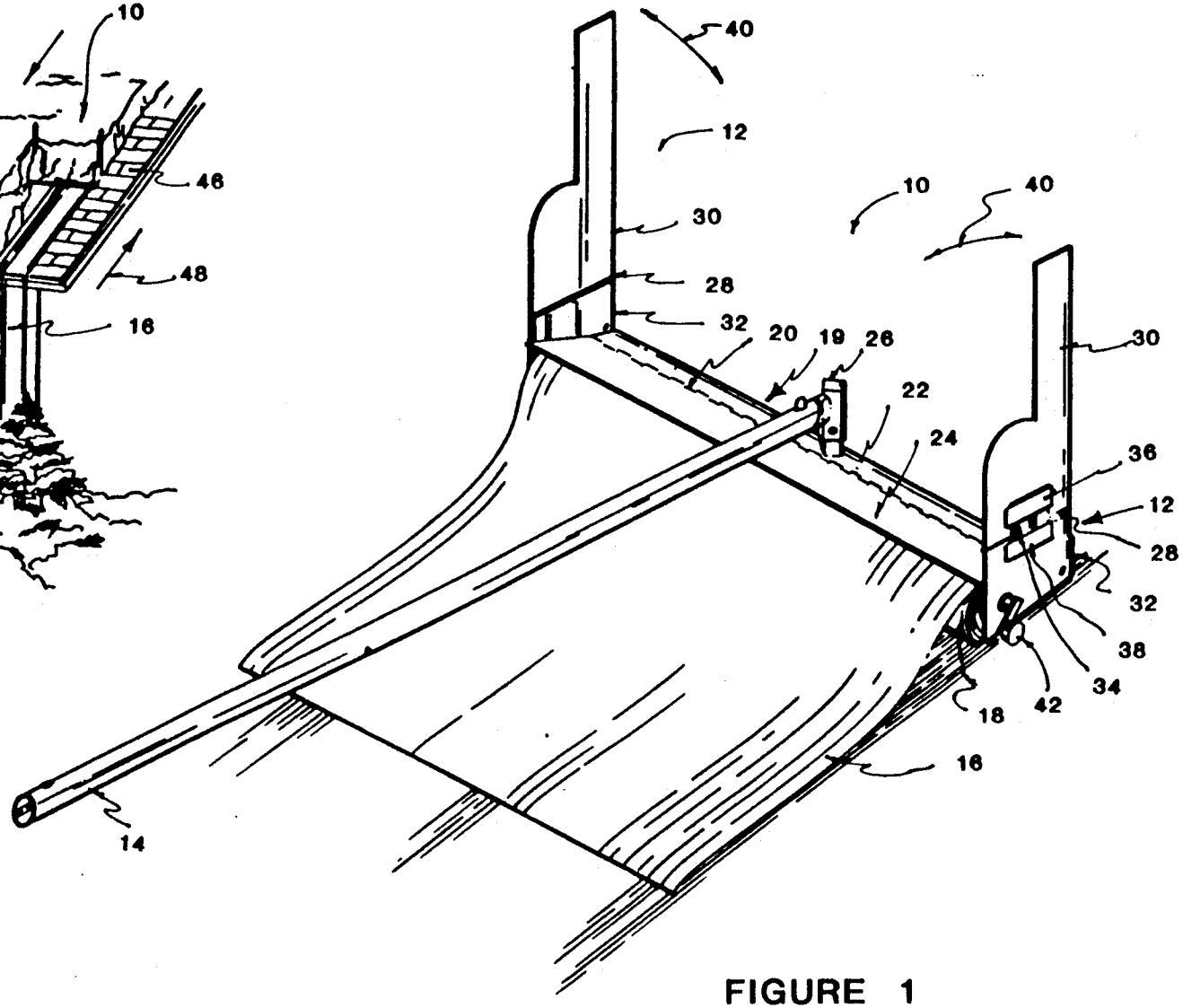
FIG. 1 is a front perspective view of the snow removal device constructed in accordance with the present invention.

FIGS. 1-7 illustrate a roof snow removal device constructed in accordance with the present invention. The snow removal device of the invention includes means for placing a slippery or frictionless surface on the roof and means for directing snow on the roof onto the surface so that it may fall from the roof. Referring to FIG. 1, generally stated, the snow removal device 10 includes a pair of vertical snow cutting means 12 a horizontal snow cutting means 19, a handle 14, and snow sliding means for placing a frictionless surface on the roof in the form of a plastic runner 16 and a roller assembly 18.

The horizontal cutting means 19 consists of a hinge 20 connecting a fixed horizontal cutting blade 22 to a vertically moveable cutting blade follower 24.

Handle 14 is affixed to cutting blade 22 by a rotatable handle receptacle 26. The receptacle 26 can be rotated 180° and pinned in place so that the handle 14 is also rotated in the horizontal plane 180°.

Cutting frame hinges 28 rotatably connect a pair of upper cutting frames 30 to lower cutting frames 32. Frames 30 and 32 are maintained parallel and upright by inserting latch bar 34 into upper latch bracket 36 and lower latch bracket 38. Removal of latch bar 34 allows the upper cutting frames 30 to be folded down as shown by arrows 40 for storing or shipping. The plastic sheet 16 is also stored by rolling it up on the roller assembly 18 by a crank means 42.

Figure 2:
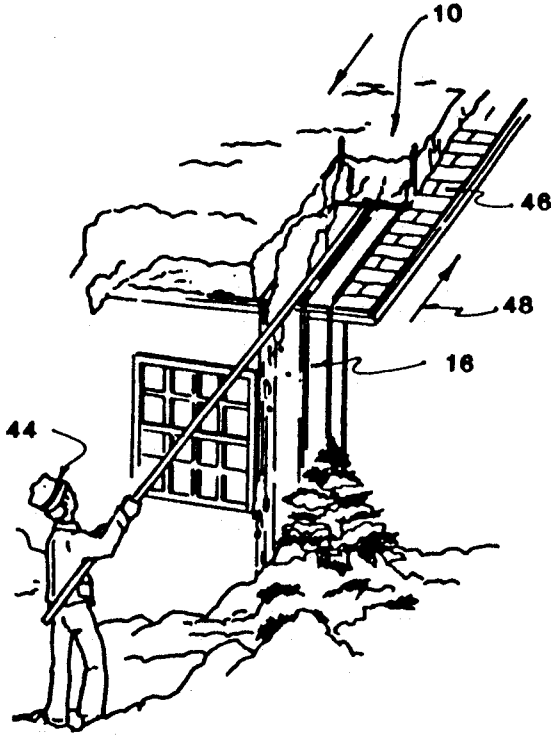
FIG. 2 is a perspective view of the present invention in use.

The handle position of the apparatus 10 in FIG. 1 is positioned for roof snow removal from a ground position as shown in FIG. 2. FIG. 2 illustrates an operator 44 who has unrolled plastic sheet runner 16 and is pushing the snow removal apparatus 10 up the roof 46 as in arrow direction 48. As the apparatus slides up the roof 46, the vertical cutting frames 30 and 32 and the horizontal cutting blade 22 cut a square section of snow which then slides down over the plastic sheet to fall on the ground. This operation is enhanced by the frictionless or extremely low coefficient of friction of the plastic as compared to the friction coefficient of roof shingles, the shingles coefficient being an order of magnitude higher.

Figure 3:
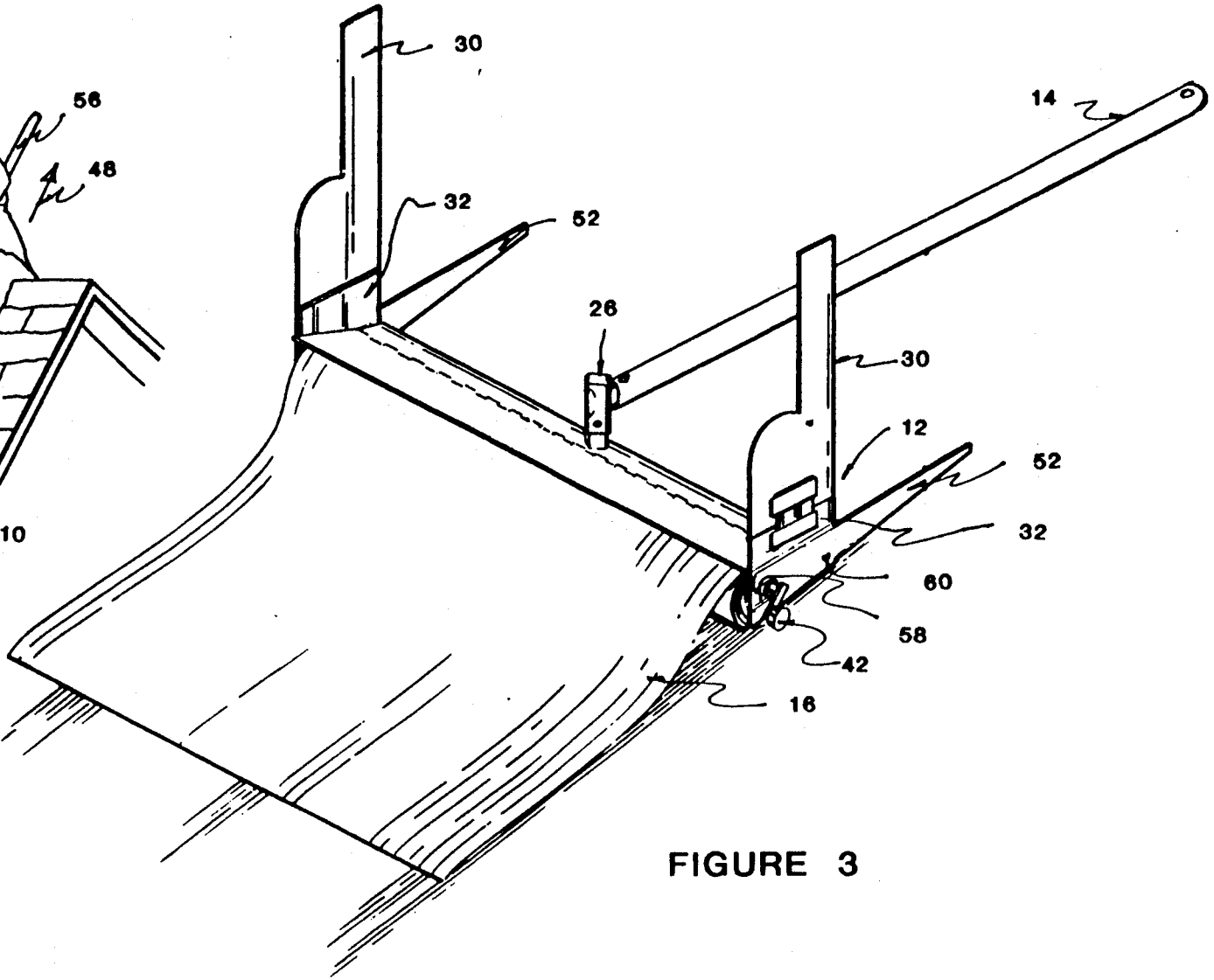
FIG. 3 is a front perspective view of the present invention having attachments in place.
Figure 4:
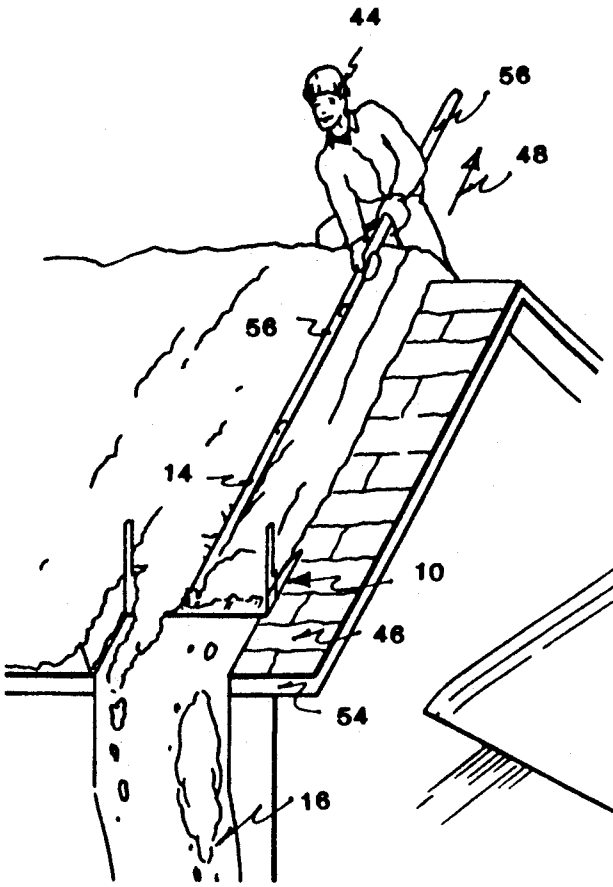
FIG. 4 is a perspective view of the present invention of FIG. 3 in use.

A second configuration is illustrated in FIGS. 3 and 4 where the operator is able to straddle the roof ridge 50 when the roof is not too steep. For this type of operation, the handle 14 and the handle receptacle 26 are rotated 180°, and the operator 44 pulls the apparatus in direction of arrow 48. As described above, the square cut section of snow slides over the plastic 16 to the ground. This mode of operation is enhanced by the addition of two elongated runners 52, which allow the operator 44 to extend the apparatus 10 beyond the eaves 54 edge of the roof 46, to aid in removing the snow at the eaves. The runners 52 are easily attached by inserting slot 58 over crank means and bolting as at 60. In this figure, handle extension pieces 56 have been added to extend the operating length.

Figure 6:
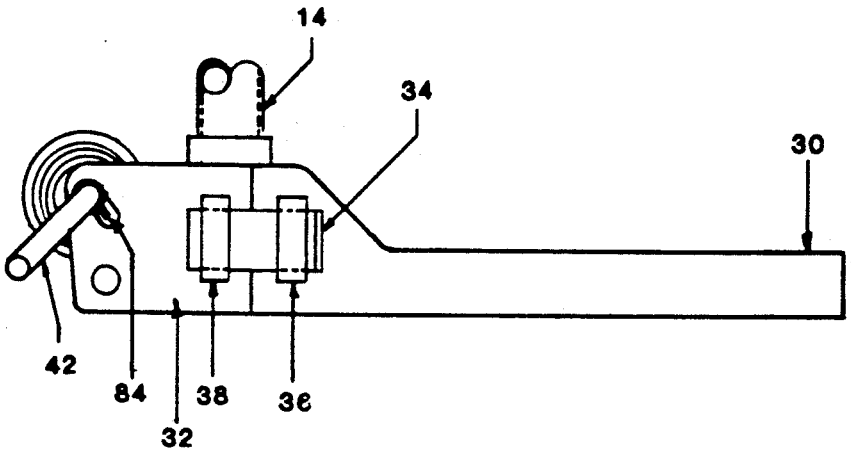
FIG. 6 is a side elevation of the present invention, taken along lines 6—6 of FIG. 5.
Figure 5:
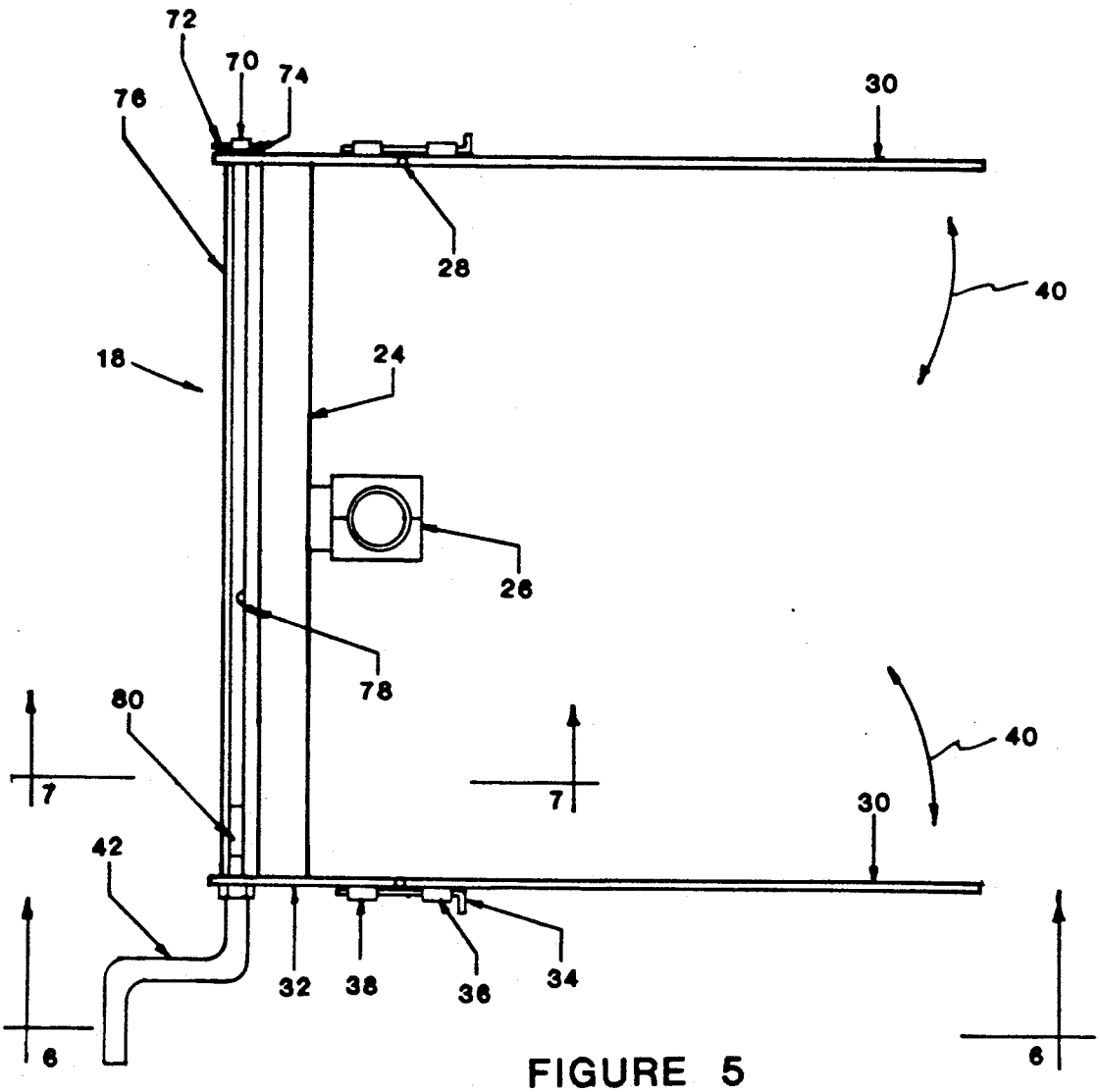
FIG. 5 is a front elevation of the present invention.
Figure 7:
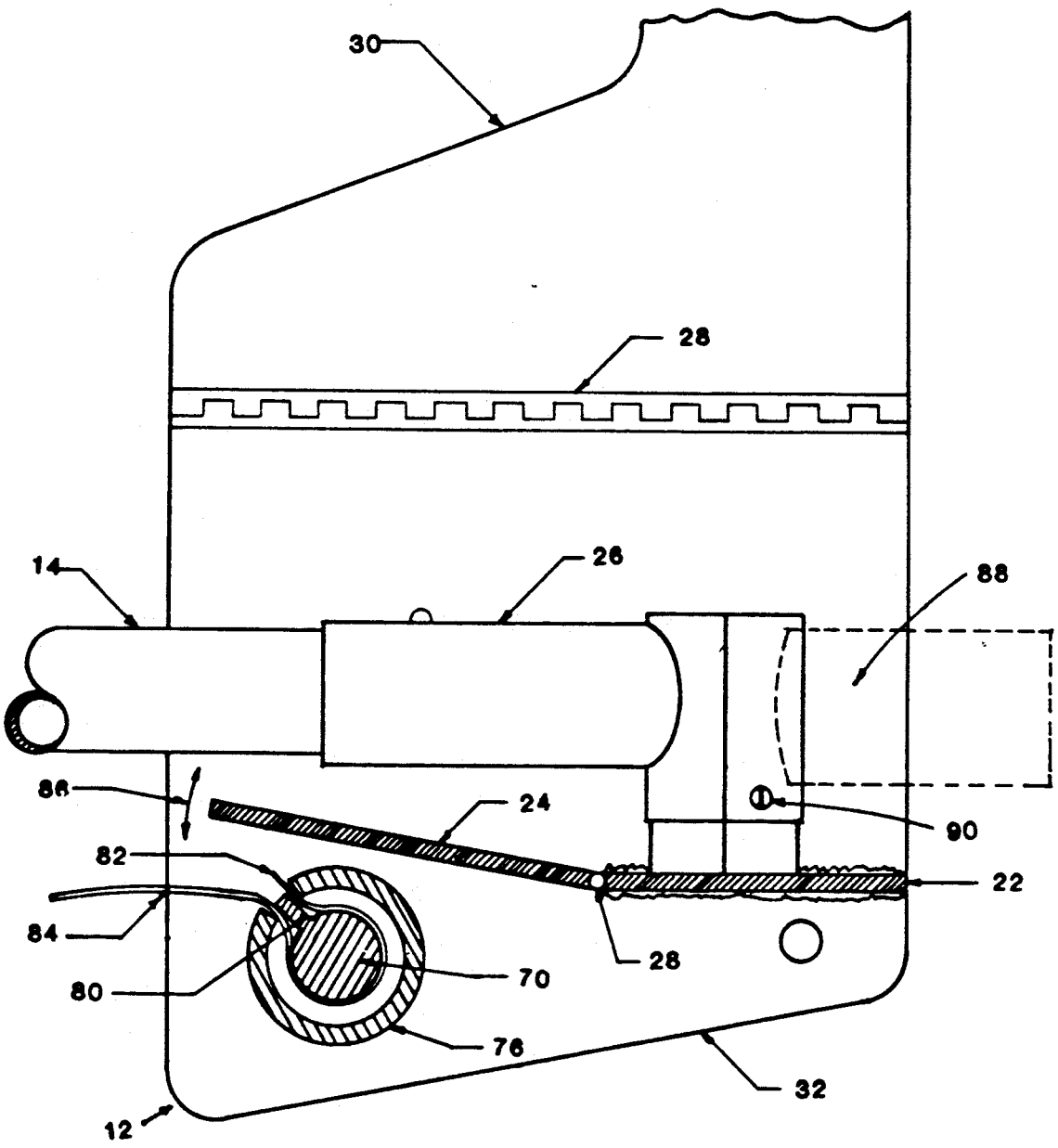
FIG. 7 is a cross sectional view taken along lines 7—7 of FIG. 5.

The details of the apparatus can be more clearly seen by referring to FIGS. 5, 6, and 7. FIG. 5 illustrates more detail of the roller assembly 18 with plastic sheet 16 removed. Elongate rod 70 having cranking means 42 at one end has a cotter pin 72 and flat washer 74 at a second end to prevent withdrawal of the rod through an aperture in lower bracket 32. Rod 70 is inserted within elongate tube 76 which has a linear slot 78 running along its outer periphery. The slot 78 has two purposes: first, it acts as a key way for rod 70 and engaging drive key 80; and, secondly, allows the sheet 16 to be inserted through the slot to form a loop 82 surrounding rod 70 as seen in FIG. 7. Rotation of crank means 42 drives the rod 70, key 80 and turns tube 76 to either roll up (to store) or unroll sheet 16 when ready to use.

Referring to FIG. 6, the keyway can be inserted through a key aperture 83 in lower cutting frame 32. This allows removal of rod 70 to permit replacing the plastic sheet 16. Removal of the rod 70 is done by first removing cotter pin 72 at the second end of rod 70.

Referring now to enlarged sectional view, FIG. 7, of the roller assembly 18 and cutting means 12 and 19, the plastic sheet loop 82 can be seen wrapped around elongate rod 70 within the slotted tube 76. The long free end 84 of sheet 16 is allowed to lay on the roof section 46 and drape over the eaves 54 as in FIG. 4. FIG. 7 also discloses how hinged cutting blade follower 24 rests on either the rolled up sheet 16 or on the elongate tube 70, as indicated. The hinge at 20 allows motion as shown by arrow 86. This figure also indicates in phantom the reversed position 88 of square based handle receptacle 26 for roof raking from the roof peak. Receptacle 26 is easily removed by removing pin 90.

Typical materials of construction include aluminum and strong plastic or a combination of both. Preferred dimensions are about an 18" length horizontal cutting blade and an 18" height vertical cutting frame. Handle section lengths can be five feet in length and one inch in diameter depending on the material used. The elongate rod diameter is about ⅜" and the enclosing tube about ¾" diameter. The plastic can be clear, ribbed polyethylene having a general thickness of 12 mils and a rib thickness of 30 mils, the rib providing a degree of stiffness so that it lays flat on the roof in the wind.

It is apparent from the foregoing that a novel and unobvious roof clearing apparatus has been provided giving the option of cleaning snow from the ground or from a ladder on the ground or, if safe enough, i.e., shallow roof slope, from the roof peak.

While the apparatus of the invention has been described with reference to a preferred embodiment, as will be apparent to the skilled in the art, certain changes and modifications can be made without departing from the scope of the invention as defined by the following claims.

What is claimed is:

1. An improved snow removal apparatus for removing snow from a roof, comprising:

a. a pair of generally vertical cutting means further comprising:
- an upper cutting frame;
- a hinge attached to a lower edge of the upper cutting frame;
- a lower cutting frame attached to the hinge;
- a pair of brackets wherein a first bracket is attached to the upper cutting frame and a second bracket is attached to the lower cutting frame, such that when a bar latch is inserted within each bracket, the upper cutting frame is maintained in a generally vertical plane in line with the lower cutting frame, and wherein removal of the bar latch permits folding the upper cutting frames to a down "store" position when the apparatus is not in use;

b. a horizontal cutting means affixed between the vertical cutting means generally perpendicular to the vertical cutting means further comprising:
- a fixed horizontal cutting blade;
- a hinge affixed to an edge of the horizontal cutting blade; and
- a moveable hinged horizontal cutting blade affixed to the hinge such that the moveable cutting blade rests on a rolled slippery material in a first stored position and on a roller assembly in a second unrolled position;

c. the roller assembly rotationally affixed between the vertical cutting means further comprises:
- an elongate tube having a linear slot along an outer periphery of the tube;
- an elongate rod affixed within the tube having a key affixed on an outer periphery engaging the linear slot;
- a fold on the end of the slippery material which is inserted within the tube slot and held in place by the rod inserted within the tube; and
- a crank means affixed to one end of the rod, adjacent the key, such that rotation of crank means rolls up the slippery material on the tube to the stored position;

d. a handle adjustably affixed to the horizontal cutting means; and wherein the snow on the roof is cut by the cutting means and directed onto the slippery material in the second unrolled position and then directed off the roof.

2. The apparatus as defined in claim 1 and wherein the pair of vertical cutting means further comprises:
- an upper cutting frame;
- a hinge attached to a lower edge of the upper cutting frame;
- a lower cutting frame attached to the hinge; and
- a pair of brackets wherein a first bracket is attached to the upper cutting frame and a second bracket is attached to the lower cutting frame, such that when a bar latch is inserted within each bracket, the upper cutting frame is maintained in a generally vertical plane in line with the lower cutting frame.

3. The apparatus as defined in claim 2 and wherein removal of the bar latch permits folding the upper cutting frames to a down "store" position when the apparatus is not in use.

4. The apparatus as defined in claim 1 and wherein the horizontal cutting means further comprises:
- a fixed horizontal cutting blade;
- a hinge affixed to an edge of the horizontal cutting blade; and
- a moveable hinged horizontal cutting blade affixed to the hinge such that the moveable cutting blade rests on the rolled slippery material in the first stored position and on the roller assembly in the second unrolled position.

5. The apparatus as defined in claim 1 and wherein the roller assembly further comprises:
- an elongate tube having a linear slot along an outer periphery of the tube;
- an elongate rod affixed within the tube having a key affixed on an outer periphery engaging the linear slot;
- a fold on the end of the slippery material which is inserted within the tube slot and held in place by the rod inserted within the tube; and
- a crank means affixed to one end of the rod, adjacent the key, such that rotation of crank means rolls up the slippery material on the tube to the stored position.

6. An improved snow removal apparatus for removing snow from a roof comprising:

a. a pair of vertical cutting frames further comprising:
- an upper cutting frame;
- a hinge attached to a lower edge of the upper cutting frame;
- a lower cutting frame attached to the hinge; and
- a pair of brackets wherein a first bracket is attached to the upper cutting frame and a second bracket is attached to the lower cutting frame, such that when a bar latch is inserted within each bracket, the upper cutting frame is maintained in a generally vertical plane in line with the lower cutting frame;

b. a horizontal cutting blade affixed between the vertical cutting frames and generally perpendicular to the cutting frames further comprising:
- a fixed horizontal cutting blade;
- a hinge affixed to an edge of the horizontal cutting blade; and a moveable hinged horizontal cutting blade affixed to the hinge such that the movable cutting blade rests on a rolled plastic sheet in a first stored position and on a roller assembly in a second unrolled position;

c. the roller assembly rotationally affixed between the vertical cutting frames further comprises:

an elongate tube having a linear slot along an outer periphery of the tube;

an elongate rod affixed within the tube having a key affixed on an outer periphery engaging the linear slot;

a fold on the end of the plastic sheet which is inserted within the tube slot and held in place by the rod inserted within the tube; and a crank means affixed to one end of the rod, adjacent the key, such that rotation of crank means rolls up the plastic sheet on the tube to the stored position;

d. a handle adjustably affixed to the horizontal cutting blade; and wherein the plastic sheet is rolled up on the roller assembly in a first stored position and is in the second unrolled position when in use on the roof.

7. The apparatus as defined in claim 6 and wherein the pair of vertical cutting frames further comprises:

an upper cutting frame;

a hinge attached to a lower edge of the upper cutting frame;

a lower cutting frame attached to the hinge;

a pair of brackets, wherein a first bracket is attached to the upper cutting frame and a second bracket is attached to the lower cutting frame, such that when a bar latch is inserted within each bracket, the upper cutting frame is maintained in a generally vertical plane in line with the lower cutting frame.

8. The apparatus as defined in claim 6 and wherein the horizontal cutting blade further comprises:

a fixed horizontal cutting blade;

a hinge affixed to an edge of the horizontal cutting blade;

a moveable hinged horizontal cutting blade affixed to the hinge such that the moveable cutting blade rests on the rolled plastic in the stored position and on the roller assembly in the second unrolled position.

9. The apparatus as defined in claim 6 and wherein the roller assembly further comprises:

an elongate tube having a linear slot along an outer periphery of the tube;

an elongate rod affixed within the tube and having a key affixed on an outer periphery engaging the linear slot;

a fold on the end of the plastic sheet which is inserted within the tube slot and held in place by the rod inserted within the tube;

a crank means affixed to one end of the rod, adjacent the key, such that rotation of crank means rolls up the plastic on the tube to the stored position.

* * * * *